US006328078B1

(12) United States Patent
Wildeman et al.

(10) Patent No.: US 6,328,078 B1
(45) Date of Patent: Dec. 11, 2001

(54) SYSTEM AND PROCESS FOR FORMING A FABRIC HAVING DIGITALLY PRINTED WARP YARNS

(75) Inventors: Martin Wildeman, Spartanburg, SC (US); Jeffrey A. Carpenter, Columbus, NC (US); Lawrence F. Houghton, Roebuck, SC (US)

(73) Assignee: Tietex International, Ltd., Spartanburg, SC (US)

( * ) Notice: Subject to any disclaimer, the term of this patent is extended or adjusted under 35 U.S.C. 154(b) by 0 days.

(21) Appl. No.: 09/643,546

(22) Filed: Aug. 22, 2000

Related U.S. Application Data

(63) Continuation-in-part of application No. 09/310,360, filed on May 12, 1999, now Pat. No. 6,105,624, which is a continuation of application No. 09/042,123, filed on Mar. 13, 1998, now Pat. No. 5,983,952.

(51) Int. Cl.[7] ..... D03D 25/00

(52) U.S. Cl. ..... 139/383 R; 101/481; 101/485

(58) Field of Search ..... 139/1 R, 383 R; 101/481, 485

(56) References Cited

U.S. PATENT DOCUMENTS

| | | | | |
|---|---|---|---|---|
| 5,801,739 | * | 9/1998 | Silverbrook | 347/101 |
| 5,983,952 | * | 11/1999 | Carpenter et al. | 139/1 R |
| 6,038,977 | * | 3/2000 | Haney et al. | 101/490 |
| 6,105,624 | * | 3/2000 | Wildeman et al. | 139/383 R |

FOREIGN PATENT DOCUMENTS

070950 * 3/1995 (JP) .

* cited by examiner

*Primary Examiner*—Andy Falik
(74) *Attorney, Agent, or Firm*—Dority & Manning, P.A.

(57) ABSTRACT

A process and system for printing a pattern onto a set of warp yarns which are then woven into a fabric. Specifically, the fabric is woven so that the printed pattern is viewable from at least one side of the fabric. In accordance with the present invention, the printed pattern is applied to the warp yarns using a digital printing device, such as an ink jet print device.

27 Claims, 3 Drawing Sheets

SYSTEM AND PROCESS FOR FORMING A FABRIC HAVING DIGITALLY PRINTED WARP YARNS

RELATED APPLICATIONS

The present application is a continuation in part application of U.S. Ser. No. 09/310,360 filed on May 12, 1999, now U.S. Pat. No. 6,105,624 issued on Aug. 22, 2000 which is a continuation of U.S. Ser. No. 09/042,123 filed on Mar. 13, 1998 and now U.S. Pat. No. 5,983,952 issued on Nov. 16, 1999.

FIELD OF THE INVENTION

The present invention is generally directed to a system and process for transferring a design onto a set of warp yarns which are then woven into a fabric incorporating the design. More particularly, the present invention is directed to a process and system for digitally applying a printed pattern to the warp yarns using, for instance, ink jet printing.

BACKGROUND OF THE INVENTION

Woven fabrics are produced on various types of weaving machines, commonly referred to as shedding devices. Examples of shedding devices include, for instance, a cam weaving device and a Dobby weaving device, which generally produce fabrics having a single and uniform weave. More complicated weaving systems capable of producing fabrics containing multiple weaves are generally referred to as jacquard weaving systems.

In the past, attempts have been made to incorporate printed patterns into woven fabrics. In particular, attempts have been made to produce a fabric containing a printed design in combination with a woven design. Having the capability of combining a printed design with a woven design offers the ability to produce fabrics containing many different patterns and colors that have a unique and distinctive appearance.

For instance, one technique used in the past was to print a pattern onto a set of warp yarns prior to weaving the yarns into a fabric. If woven in an appropriate manner, the pattern applied to the warp yarns becomes visible in the resulting fabric. Other applications which discuss warp yarn printing include U.S. Pat. No. 5,212,845 to Corbiere and the present inventors' prior applications having U.S. Ser. Nos. 09/042,123 and 09/226,342, which are all incorporated herein by reference in their entireties.

Generally, in the past, the preferred methods for applying a printed pattern onto the warp yarns in a warp yarn printing process included screen printing and heat transfer printing. In each of these printing methods, typically the printing device includes a substrate, such as a roll of transfer paper or an engraved roll, that has a design imprinted onto the substrate. The substrate is used to apply the design to a moving web of warp yarns.

Unfortunately, however, each of the above printing techniques has limitations. For instance, since the design is preprinted onto the substrate that is applied to the warp yarns, it is generally not easy to make adjustments in the printed design during processing. Also, these printing devices typically do not provide a great amount of flexibility in switching from one design to another. For instance, in order to switch designs during processing, the preprinted or engraved substrate typically needs to be removed from the printing device and replaced. Further, since the substrates are prefabricated, a certain amount of time is required from when a new design is created until that design can be applied to a set of warp yarns and incorporated into production.

In view of the above deficiencies and drawbacks, a need currently exists for an improved system and process for printing a design onto a set of warp yarns that are to be woven into a fabric. In particular, a need exists for a process and system for printing a design onto a set of warp yarns that offers greater flexibility and more controls than printing techniques used in the past.

SUMMARY OF THE INVENTION

The present invention recognizes and addresses the foregoing disadvantages, and other disadvantages of prior art constructions and methods.

Accordingly, it is an object of the present invention to provide an improved system for producing woven, knitted or stitchbonded fabrics containing a printed pattern.

It is another object of the present invention to provide a system and process for printing a design onto a set of warp yarns.

Another object of the present invention is to provide a system and process for printing a design onto a set of warp yarns using a printer having a digitally controlled pattern.

Still another object of the present invention is to provide a process and system for applying a design onto a set of warp yarns using an ink jet printer.

Another object of the present invention is to provide a weaving system that maintains a printed pattern in alignment with a woven pattern.

It is another object of the present invention to provide a fabric containing synchronized printed and woven patterns.

These and other objects of the present invention are achieved by providing a process for printing a pattern onto a set of warp yarns during the fabrication of a woven product. The process includes the steps of providing a set of moving warp yarns that are substantially parallel. In accordance with the present invention, a pattern is printed onto the set of warp yarns using a digital printing device as the yarns are moving. For instance, the pattern can be transferred to the yarns using an ink jet printing device that can be digitally controlled. Once the pattern is applied to the warp yarns, weft yarns are then woven into the warp yarns for producing a fabric, wherein the ink jet printed pattern is visible from at least one side of the fabric.

In order to make the warp yarns receptive to ink jet printing, in one embodiment, the warp yarns can be pretreated in order to enhance their receptivity to ink jet printing and/or to improve the clarity of the printed pattern.

In one embodiment, the process can further include the step of creating a woven pattern into the fabric that compliments the printed pattern. In this embodiment, the digital printing device can be used to maintain the printed pattern in alignment with the woven pattern as the fabric is formed. In particular, the digital printing device can include a controller that monitors the position of the woven pattern and the printed pattern as the fabric is being woven. Based on the position of the printed pattern relative to the woven pattern, the controller can selectively adjust the position of the printed pattern in a manner that maintains the patterns in alignment. For instance, if a misalignment of the patterns is detected, the controller can be configured to control the digital printing device for adjusting the position of the printed pattern in order to realign the printed pattern with the woven pattern. In particular, the controller can be configured to automatically change the size of the printed pattern when an adjustment is necessary.

In order to monitor the position of the woven pattern, the weaving device used in the process of the present invention can include a weaving controller. The weaving controller can then send information regarding the progress of the woven pattern to the controller used in conjunction with the digital printing device.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
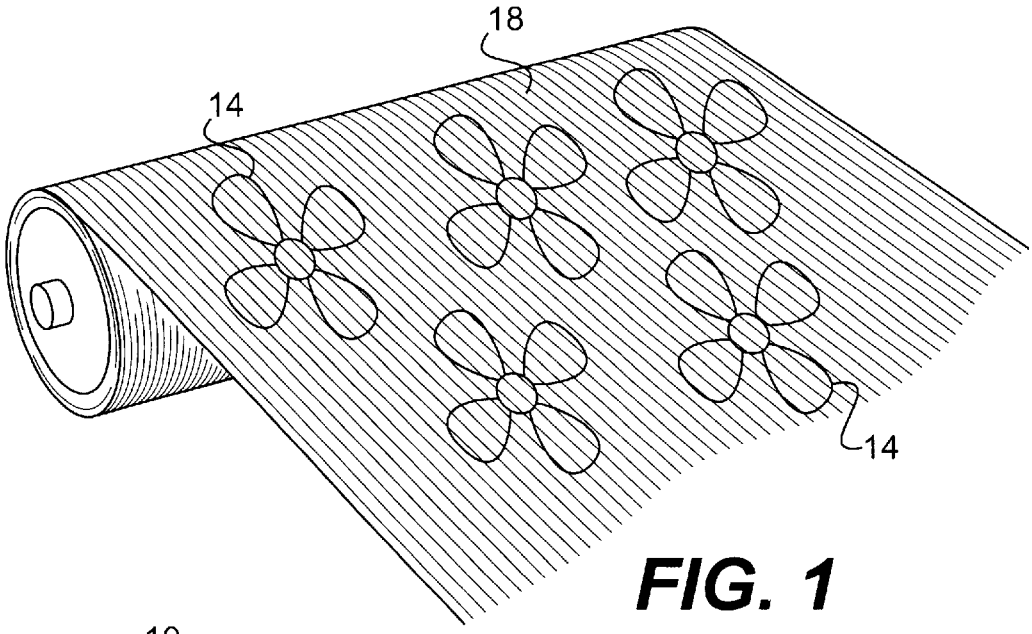
FIG. 1 is a perspective view of a set of warp yarns having a printed pattern thereon.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a system and process for printing a design onto a set of warp yarns. The warp yarns are then woven into a fabric in a manner so that the printed design can be viewed from at least one side of the fabric.

In accordance with the present invention, the design is printed onto the warp yarns using a printing device that is preferably digitally controlled such as an ink jet printing device. As used herein, ink jet printing refers generally to a printing device that includes a thermal ink jet print head. The print head contains an electrical resistor in the ink chamber which functions as a heater when current flows through it, increasing the temperature of a small volume of a fluid. The super heated fluid produces a steam bubble which grows for several microseconds. The bubble forces a drop of ink measured in picoliters from the nozzle at a high rate of speed. The ink is shot out in a long thin drop which forms a sphere as it heads towards the paper. After ejecting the drop, the bubble cools in microseconds and collapses, drawing the ink meniscus back into the nozzle and also drawing more ink into the chamber. After a very short period of time, the chamber is ready to fire again.

In high speed operations, the print head can include multiplexed addressing logic. The multiplexing logic and heaters are fabricated together on a single piece of silicon.

It should be understood, however, that any suitable digitally controlled printing device can be used in accordance with the present invention. Such devices may or may not contact the substrate. Such devices can include a piezoelectric printing device, a bubble jet printing device and the like.

In the past, ink jet printing has been used in various applications, especially for printing onto paper substrates. Recently, however, ink jet printing has been used to print designs onto fabrics. Various problems, however, have been experienced in ink jet printing onto fabrics. For instance, some fabrics will not readily accept the inks. Further, fabrics may tend to disperse the inks upon contact which makes the resulting image look fuzzy. Further, current ink jet printers are relatively slow, especially in comparison to conventionally used printing devices.

Using an ink jet printer in accordance with the present invention offers many advantages and benefits not before realized in warp printing processes. For instance, since ink jet printing devices are digitally controlled, designs being printed onto substrates can be instantaneously adjusted as desired. Ink jet printers can also store a limitless number of designs and can be switched between designs easily and almost instantaneously. Further, ink jet printing devices allow designs to be created and used very rapidly.

In view of the flexibility provided by ink jet printing devices, the present invention is also directed to a weaving system designed to automatically synchronize a woven pattern with the ink jet printed pattern during the formation of the fabric. The woven pattern can be, for instance, a pattern woven into the fabric using different colored yarns and/or a pattern woven into the fabric by varying the weave. For example, in one embodiment, the woven pattern can be a jacquard pattern incorporated into the fabric. It should be understood, however, that various other woven patterns may be used.

By maintaining the woven pattern in alignment with the printed pattern, both patterns can be used to enhance and compliment each other. Through the process of the present invention, fabric products can be produced having a unique and stylized overall design and appearance.

In particular, a computer controlled woven pattern is designed that exactly matches the digitally printed warp pattern. The warp yarns are fed to a weaving device, and the woven pattern is cued to begin at the same point as the printed pattern. To maintain a match between the woven pattern and the printed pattern, both the warp pattern and the woven pattern are monitored. For instance, the ink jet printing device can include a programmable controller, such as a computer, that stores the design being printed on the warp yarns. As the design is printed on the warp yarns, the printer controller can monitor the progress of the pattern. The woven pattern, on the other hand, can be monitored by determining from the weaving device or loom (or from a jacquard controller if the woven pattern includes a jacquard pattern) the number of picks per inch and the total number of picks woven.

As long as the woven pattern and the printed pattern remain in alignment, the system takes no corrective action. If any type of misalignment is detected, however, the printer controller automatically changes the printed pattern for maintaining both patterns in alignment.

In an alternative embodiment of the present invention, the digital printer can be used to apply a printed design onto a set of warp yarns that are then wound onto a reel or otherwise stored. Once the printed pattern is applied to the warp yarns, the warp yarns can then be later fed through a weaving device for forming a fabric. This embodiment of the present invention is particularly well suited for applications where the digital printer operates at a slower rate than the weaving device.

In this embodiment, in order to maintain the printed pattern in alignment with the woven pattern if desired, the weaving device can include a controller which receives information regarding the position of the printed pattern and the woven pattern. Should it be determined that the patterns are out of alignment, the controller can be configured to make adjustments in the weaving device for once again placing the patterns in alignment. Such a system is described in U.S. Pat. Nos. 5,983,952 and 6,105,624 which are both incorporated herein by reference in their entireties.

In general, any suitable weaving device may be used in conjunction with an ink jet printing device in accordance with the present invention as described above. Examples of weaving devices include less complex devices such as a cam weaving device or a Dobby weaving device. A cam device and a Dobby device are capable of producing a woven pattern by varying the color of the weft yarns as they are inserted into the warp yarns. In accordance with the present invention, the woven pattern can be aligned with a printed pattern applied to the warp yarns.

In one preferred embodiment of the present invention, the weaving device is a device that is capable of producing a woven pattern by not only varying the color of the weft yarns but also by varying the weave that is used to create the fabric. For example, the weaving device can be a jacquard weaving device or other suitable weaving device such as a Dobby weaving device.

Referring to the figures, the process and system of the present invention will now be described in detail with respect to the embodiments illustrated. Referring particularly to FIG. 1, a roll of warp yarns 18 is illustrated which, as shown, is in a condition ready to be fed to a weaving device in accordance with the present invention. As shown, a printed pattern 14 has been applied to warp yarns 18 prior to weaving the yarns into a fabric. In accordance with the present invention, printed pattern 14 is printed onto the yarns using a digital printing device.

Warp yarns 18 can be made from various materials, including synthetic materials and natural fibers. A material should be used, however, that works well with digital printers, such as ink jet printers. For instance, although not critical to the process of the present invention, warp yarns 18 can be made from polyester, cotton, wool, rayon or nylon. The yarns can be spun yarns or filament yarns. For most applications, prior to being subjected to the printing process, warp yarns 18 can be sized using, for instance, a slasher. The size composition can be applied to the yarns in order to facilitate weaving and/or in order to facilitate application of the ink to the yarns. For instance, size compositions, such as starch solutions or polyester resins, decrease friction and can improve the strength of the yarns. Alternatively, the yarns can be sized with a size composition that facilitates acceptance of the ink from the printer.

Figure 2:
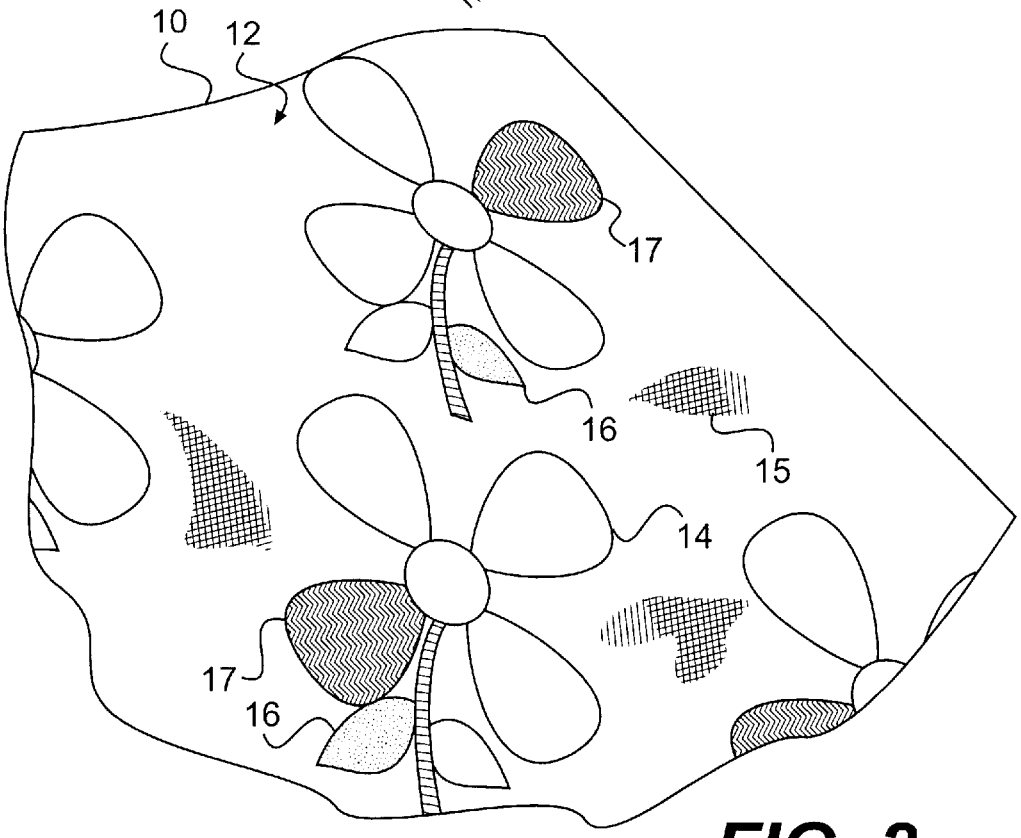
FIG. 2 is a partial perspective view of a fabric product made in accordance with the present invention illustrating a woven pattern and specifically a jacquard pattern in synchronization with a printed pattern.

Once ink jet printed pattern 14 is applied to warp yarns 18, the yarns are then woven into a fabric generally 10 as shown in FIG. 2. For exemplary purposes only, fabric 10 represents a jacquard fabric made using a jacquard weaving device in conjunction with the digital printer.

As shown, fabric 10 includes a repeating jacquard pattern generally 12. Jacquard pattern 12 includes a ground weave 15 which, in this embodiment, is represented as a plain weave, and a first motif 16. Motif 16 is created by varying the weave within the fabric. In this embodiment, printed pattern 14 represents a flower, while motif 16 is intended to represent the stem and leaves of the flower.

In one alternative embodiment, besides only containing first motif 16, jacquard pattern 12 can include various other motifs as desired. The other motifs can be made from the same weave or from a different weave than motif 16. For instance, as shown in FIG. 2, a second motif 17 is represented. In this embodiment, motif 17 is intended to represent and accentuate the petals of the flower. In this embodiment, motif 17 has a different weave than motif 16. For instance, motif 17 could have a herringbone weave which is a type of twill weave, while motif 16 could have a type of satin weave.

Through the process of the present invention, various colors can be used if desired in order to accentuate the designs applied to the fabric. For instance, printed pattern 14 can be made from any color desired. The woven pattern, which includes ground weave 15, first motif 16, and second motif 17, can be varied in color by selecting different colored weft yarns during production of the fabric. In this manner, motif 16 can have a different color than ground weave 15 which can have a different color than second motif 17.

Further, any suitable pattern can be formed into the fabric of the present invention. Besides flowers as shown in FIG. 2, other designs can include logos, symbols, other plant designs, any decorative figure, etc.

In one embodiment, the printed pattern applied to the warp yarns can be used to make the woven pattern have sharper lines and boundaries. For instance, woven patterns due to the stitching action have patterns with boundary lines that are somewhat jagged. More particularly, stitch patterns normally include small imprecisions along the outside boundary of the design being formed. In accordance with the present invention, however, the pattern printed onto the warp yarns can be used to compensate for this effect.

Specifically, the pattern printed onto the warp yarns with a digital printer can be precisely controlled so as to produce a jagged line itself that exactly matches the stitched pattern. When the warp yarns are then incorporated into the fabric during its formation, the printed pattern exactly matches the woven pattern to create an overall design with very distinct lines.

Figure 3:
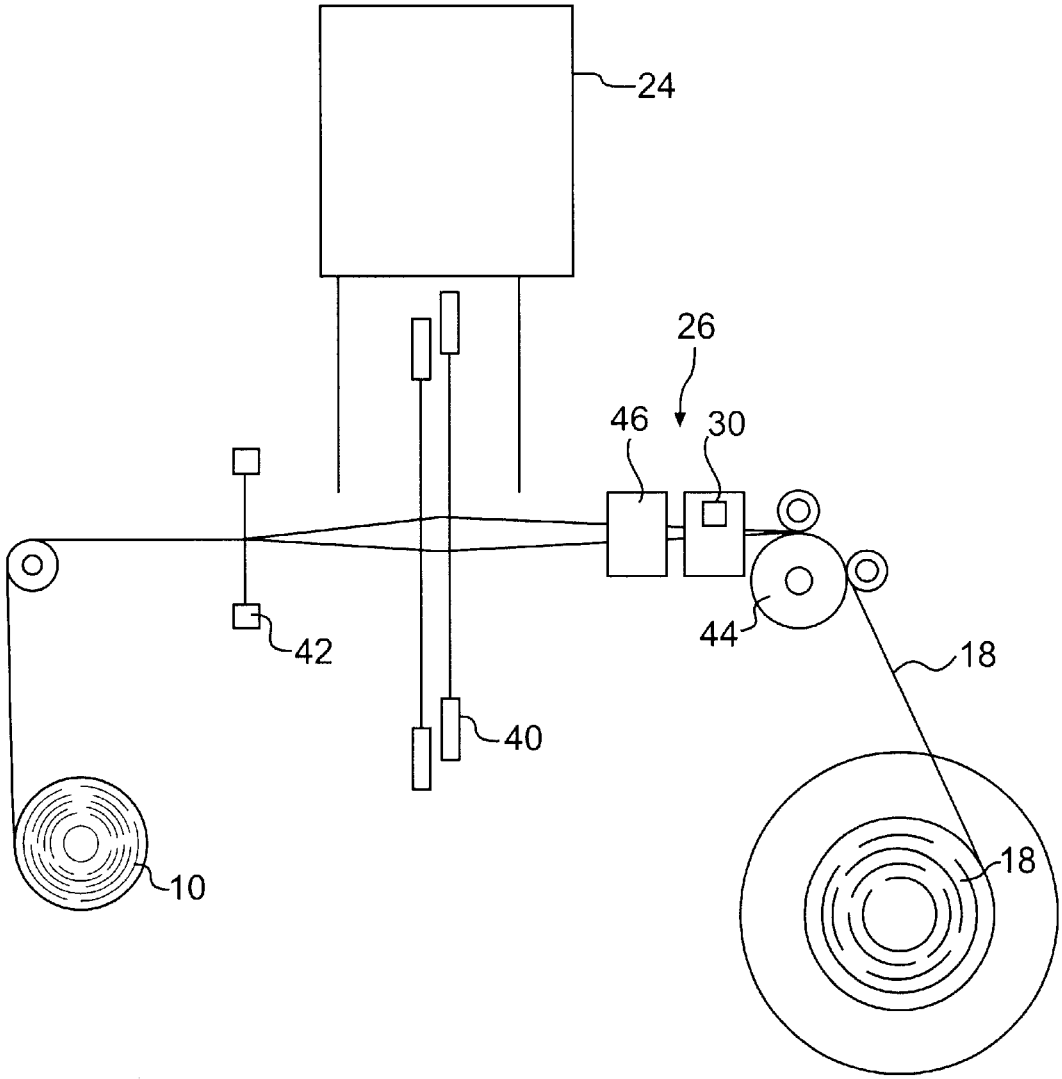
FIG. 3 is a side view of one embodiment of a system made in accordance with the present invention.

Referring to FIG. 3, one embodiment of a system for digitally printing a pattern onto a set of warp yarns and for weaving the warp yarns into a fabric is illustrated. In this embodiment, the digital printing device is represented by an ink jet printing device. As shown, a lap of warp yarns 18 is unwound and fed to a weaving device 24, such as a jacquard weaving device, in order to form woven fabric 10. In particular, warp yarns 18 are formed into a shed by heddles 40. Weft yarns are then woven into warp yarns 18 and consolidated by a reed 42.

In accordance with the present invention, warp yarns 18 are fed through an ink jet printing device generally 26. As shown, ink jet printing device 26 includes an ink jet printing head 30 which applies the printed pattern onto the yarns after the yarns have traveled around a guide roller 44.

More particularly, in one embodiment, ink jet printing device 26 traverses across the yarns in applying ink droplets without contacting the yarn. Ink jet printing head 30 can be controlled by a computer (not shown) which digitally stores the printed pattern and thereafter controls the printing head for transferring the pattern onto the yarns.

In the embodiment illustrated in FIG. 3, the printing device further includes a curing station 46 for curing the ink after it is applied to the warp yarns. Although not needed in all applications, curing station 46 can be used to increase the color-fastness of the ink.

The type of curing station that may be incorporated into the process of the present invention depends upon the type of ink used. For instance, curing station 46 can cure the ink by exposing the ink to ultraviolet light, thermal energy, a laser, other types of light energy, an electron beam, microwave energy, or plasma energy.

Figure 4:
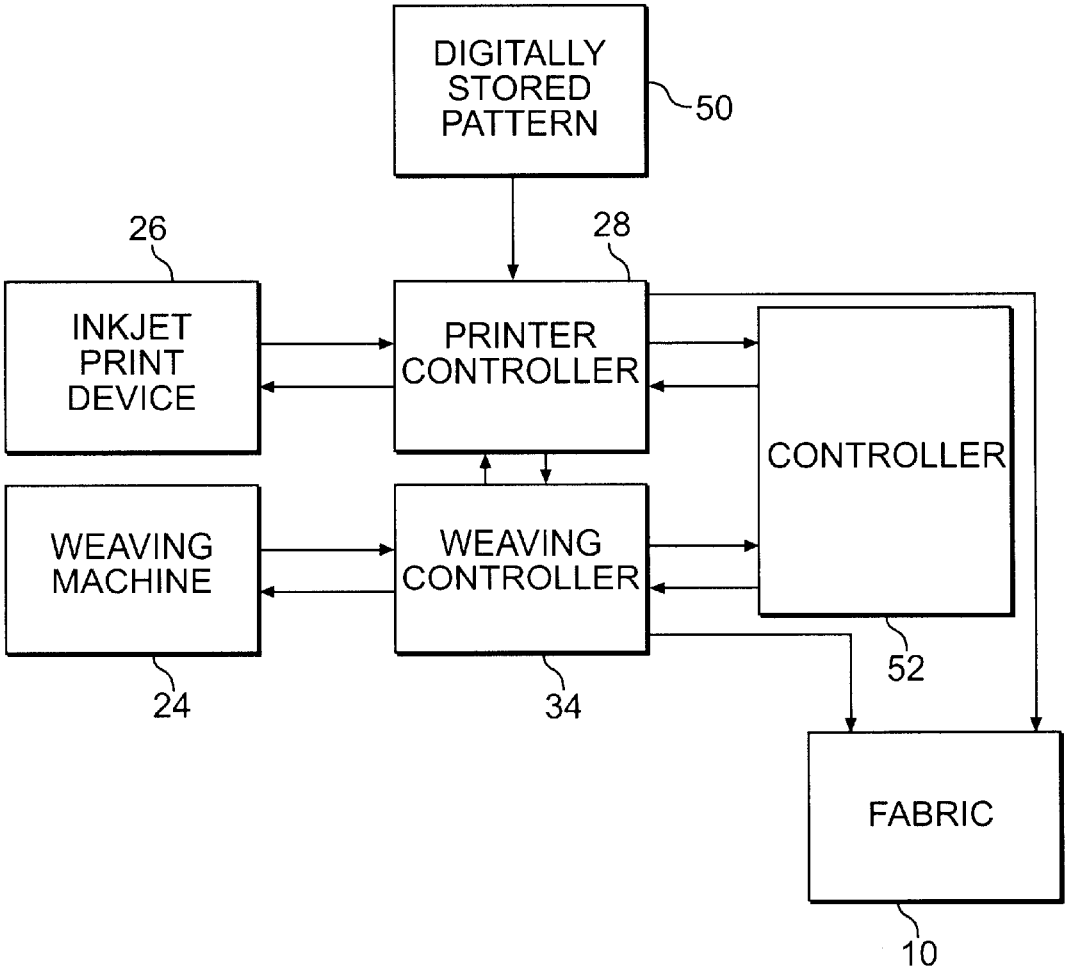
FIG. 4 is a plan view of one embodiment of a system for synchronizing an ink jet printed pattern with a woven pattern.

Besides controlling printing head 30 according to a stored pattern, the printer controller can also be used to fully automate the system so that the printed pattern always remains in alignment with a woven pattern created by weaving device 24. In this regard, one embodiment of a system for maintaining a printed pattern and woven pattern in alignment is illustrated in FIG. 4. As shown, ink jet print device 26 is in communication with a printer controller 28, while a weaving machine 24 is in communication with a weaving controller 34. Ink jet print device 26 and weaving machine 24 are used to form fabric 10.

In this embodiment, printer controller 28, which can be a microprocessor or computer, is configured to digitally store a preselected pattern 50 and to control ink jet print device 26 for transferring the pattern onto the warp yarns. Further, printer controller 28 is also configured to monitor the position of the printed pattern as fabric 10 is formed. Similarly, weaving controller 34 monitors the progress and position of the woven pattern as it is formed. In particular, weaving controller 34 can monitor the number of picks per inch that are woven into the warp yarns and the number of picks woven which can be used to determine the position of the woven pattern.

As shown, printer controller 28 and weaving controller 34 are configured to relay information regarding the progress and position of the printed pattern and the woven pattern as they are formed to a controller 52. In accordance with the present invention, controller 52 is then configured to compare the position of the printed pattern in relation to the position of the woven pattern in order to determine if the patterns are in alignment. If the patterns are not in alignment, controller 52 can be configured to alter the position of the printed pattern in relation to the position of the woven pattern and/or alter the position of the woven pattern in relation to the printed pattern until the patterns are once again in alignment.

One particular advantage of using a digital printing device is that printer controller 28 can make adjustments to the printed pattern in various ways in order to maintain the pattern in alignment with the woven pattern. For instance, printer controller 28 can automatically change the longitudinal size of the printed pattern, the width of the printed pattern or can otherwise make adjustments in the printed pattern. These adjustments can be very minor making it very difficult to see any changes in the printed pattern in the final product. Printer controller 28 can make automatic and continuous adjustments via controller 52 during the entire weaving process.

It should be understood, that the system illustrated in FIG. 4 only represents one embodiment for carrying out the process of the present invention. Various modifications can be made to the system illustrated in FIG. 4 without departing from the scope of the present invention. For instance, in an alternative embodiment, the system can include a shedding device in conjunction with a shedding controller. A shedding device is typically part of the weaving device and is responsible for forming the shed during weaving. The shed is formed by raising warp yarns. A shuttle normally passes through the shed to insert the fill or weft yarns. The shedding device and shedding controller can be in communication with the controller 52 and can be used to assist in maintaining the printed pattern and the woven pattern in alignment.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for forming a woven product comprising the steps of:

providing a set of moving warp yarns, said warp yarns being substantially parallel;

printing a pattern onto said set of warp yarns using a digital printing device as said yarns are moving; and thereafter weaving weft yarns into said warp yarns for producing a fabric, said printed pattern being visible from at least one side of said fabric.

2. A process as defined in claim 1, further comprising the step of sizing said warp yarns with a material adapted to receive said printed pattern prior to printing said pattern onto said set of warp yarns.

3. A process as defined in claim 1, wherein said digital printing device comprises an ink jet printer.

4. A process as defined in claim 1, wherein said weft yarns are woven into said warp yarns in a manner such that a woven pattern is formed into said fabric.

5. A process as defined in claim 1, wherein said digital printing device comprises a piezoelectric printer.

6. A process as defined in claim 1, wherein said process is continuous.

7. A process as defined in claim 1, wherein said warp yarns are made from a material selected from the group consisting of polyester, cotton, rayon and nylon.

8. A process as defined in claim 4, further comprising the steps of:

monitoring the position of said woven pattern and said printed pattern as said fabric is being woven; and based on the position of said printed pattern relative to the woven pattern, selectively adjusting the position of said printed pattern in a manner that maintains said woven pattern in alignment with said printed pattern as said fabric is being formed.

9. A process as defined in claim 8, wherein said printed pattern has a longitudinal size and wherein said woven pattern is maintained in alignment with said printed pattern by selectively varying the longitudinal size of said printed pattern.

10. A process as defined in claim 9, wherein the position of said printed pattern and said woven pattern is monitored by a controller, said controller being in communication with an ink jet printing device that ink jet prints said pattern onto said set of warp yarns, said controller automatically controlling the position of said printed pattern for maintaining said printed pattern in alignment with said woven pattern.

11. A process of automatically aligning and synchronizing a woven pattern with a printed pattern during the fabrication of a woven product, said method comprising the steps of:

printing a pattern onto a set of warp yarns using a digital printing device, said printed pattern having a longitudinal size;

inserting weft yarns into said warp yarns for producing a fabric, said weft yarns being woven into said warp yarns in a manner such that a woven pattern is formed into said fabric, said woven pattern also having a longitudinal size;

monitoring the position of said printed pattern as said fabric is being woven; and based on the position of said printed pattern relative to the woven pattern, selectively adjusting the position of said printed pattern in a manner that maintains said woven pattern in alignment with said printed pattern as said fabric is being formed.

12. A process as defined in claim 11, wherein said woven pattern is maintained in alignment with said printed pattern by selectively varying the longitudinal size of said printed pattern.

13. A process as defined in claim 11, wherein said woven pattern comprises a jacquard pattern.

14. A process as defined in claim 11, wherein the position of said printed pattern and said woven pattern is monitored by a controller, said controller being in communication with an ink jet printing device that ink jet prints said pattern onto said set of warp yarns, said controller automatically controlling the position of said printed pattern for maintaining said printed pattern in alignment with said woven pattern.

15. A process as defined in claim 11, further comprising the step of sizing said warp yarns with a material adapted to receive said printed pattern prior to printing said pattern onto said set of warp yarns.

16. A process as defined in claim 11, wherein said digital printing device comprises an ink jet printer.

17. A process as defined in claim 11, wherein said digital printing device comprises a piezoelectric printer.

18. A process as defined in claim 14, wherein said controller monitors the position of said woven pattern by receiving information from a weaving controller.

19. A system for producing woven products comprising:

an ink jet printing device including a printing head which applies an ink to a set of moving warp yarns positioned adjacent to said printing head, said ink jet printing device being configured to print a preselected pattern onto said warp yarns as said warp yarns are moving; and a weaving device for receiving said set of warp yarns after said printed pattern has been applied to said set of warp yarns by said printing device, said weaving device being configured to insert weft yarns into said warp yarns for forming a fabric, said printed pattern being visible from at least one side of said fabric.

20. A system as defined in claim 19, wherein said ink jet printing device is digitally controlled.

21. A system as defined in claim 19, wherein said ink jet printing device includes a programmable controller in communication with said printing head, said programmable controller electronically storing said printed pattern and controlling said printing head for transferring said printed pattern onto said warp yarns.

22. A system as defined in claim 21, wherein said programmable controller comprises a microprocessor.

23. A system as defined in claim 21, wherein said weaving device includes a weaving controller that monitors the position of a woven pattern during formation of said fabric.

24. A system as defined in claim 23, wherein said programmable controller is in communication with said weaving controller, said programmable controller being programmed to monitor the position of said printed pattern in relation to said woven pattern such that when misalignment of the patterns is detected, said programmable controller controls said ink jet printing device for adjusting the position of said printed pattern in order to realign said printed pattern with said woven pattern.

25. A system as defined in claim 24, wherein said printed pattern has a longitudinal size, and wherein said programmable controller is programmed to make adjustments in the position of said printed pattern by selectively varying the longitudinal size of said printed pattern.

26. A weaving system for synchronizing a woven pattern with a printed pattern, said system comprising:

an ink jet printing device including a programmable controller in communication with a printing head, said programmable controller digitally storing a preselected pattern and controlling said printing head for transferring said pattern onto a set of warp yarns as said warp yarns are moving, said programmable controller also monitoring the position of said printed pattern as said warp yarns are being printed;

a weaving device for receiving said set of warp yarns having said printed pattern thereon, said weaving device inserting weft yarns into said warp yarns for forming a fabric containing a woven pattern, said weaving device including a controller that monitors the position of said woven pattern as said fabric is being formed; and wherein said programmable controller is in communication with said weaving controller for monitoring the position of said printed pattern in relation to said woven pattern, wherein, when misalignment of the patterns is detected, said programmable controller controls said ink jet printing device for adjusting the position of said printed pattern in order to realign said printed pattern with said woven pattern.

27. A system as defined in claim 26, wherein said printed pattern has a longitudinal size, and wherein said programmable controller makes adjustments in the position of said printed pattern by selectively varying the longitudinal size of said printed pattern.

* * * * *